United States Patent [19]

Head et al.

[11] 4,378,631

[45] Apr. 5, 1983

[54] METHOD OF FABRICATING A CHARGE PLATE FOR AN INK JET PRINTING DEVICE

[75] Inventors: Donald L. Head, Kettering; Edward A. Dudis, Vandalia, both of Ohio

[73] Assignee: The Mead Corporation, Dayton, Ohio

[21] Appl. No.: 161,986

[22] Filed: Jun. 23, 1980

[51] Int. Cl.[3] ..... H01R 43/00

[52] U.S. Cl. ..... 29/825; 29/592 R; 346/1.1

[58] Field of Search ..... 209/15; 250/213 R; 29/592 R, 825; 346/75, 1.1; 156/644, 633, 634, 636, 330, 297, 630

[56] References Cited

U.S. PATENT DOCUMENTS

| | | | |
|---|---|---|---|
| 3,586,907 | 6/1971 | Beam et al. . | |
| 3,701,998 | 10/1972 | Mathis . | |
| 3,714,691 | 2/1973 | Aizawa et al. | 156/630 X |
| 3,988,741 | 10/1976 | Rossopoulos | 29/592 X |
| 4,112,436 | 9/1978 | Cone | 346/1.1 X |

FOREIGN PATENT DOCUMENTS

| | | | |
|---|---|---|---|
| 1392776 | 4/1975 | United Kingdom | 29/825 |

OTHER PUBLICATIONS

IBM Technical Disc. Bull. vol. 18, No. 10 (Mar. 1976) p. 3476.

*Primary Examiner*—Francis S. Husar
*Assistant Examiner*—Carl J. Arbes
*Attorney, Agent, or Firm*—Biebel, French & Nauman

[57] ABSTRACT

A method is provided for forming a charge plate (10) for an ink jet printing device which includes coating a relatively more difficult to deplate metal layer (24) on a relatively easier to deplate core wire (22), mounting a plurality of the coated wires (20) in spaced parallel relation on a nonconductive support plate (12) and attaching leads to the metal layer (24) and then deplating the core wire (22) to leave the coating to form charge tunnels in the charge plate defining cylindrical holes through which droplets of printing liquid can pass to be charged by the electrodes.

7 Claims, 6 Drawing Figures

METHOD OF FABRICATING A CHARGE PLATE FOR AN INK JET PRINTING DEVICE

BACKGROUND OF THE INVENTION

1. Field of the Invention

The present invention relates to ink jet printing devices, and more particularly, to a method of forming a charge plate for an ink jet printing device.

2. Prior Art

The present invention relates generally to ink jet printing devices of the type disclosed for example in Beam et al U.S. Pat. No. 3,586,907 and Mathis U.S. Pat. No. 3,701,998. These devices utilize charge plates which have a plurality of conductive rings aligned under the orifices from which the printing ink is expelled. An electrical charge is selectively established on each charge ring at an appropriate time to apply a charge on selected drops coming from the orifices. The selectively charged drops are subsequently deflected by an appropriately charged electrical deflection field into a catcher and thus prevented from impacting a recording medium while uncharged drops are unaffected by the electrical deflection field and thus impact the recording medium at the desired location.

Due to the fact that the charge rings formed about the orifices in the charge plate are very small in diameter, it is exceedingly difficult to fabricate such charge plates with the necessary accuracy of alignment to be in precise registry with the corresponding holes in the orifice plate. One method presently used for fabricating such charge plates employs a photo-chromic glass which is etched with the appropriate positioning of charge rings and leads extending to the circuit for individually charging each charge ring, the glass being fired to a ceramic state after etching in order to form the final charge plate assembly. However, this method is time consuming and not suffficiently repeatable to provide the high yield necessary for large volume production and in addition, the substrata generally used to support the charge rings, i.e. glass, is very fragile.

SUMMARY OF THE INVENTION

The present invention overcomes the above described difficulties and disadvantages associated with such prior art devices by providing a method of accurately fabricating a charge plate in which all of the charge rings (or in this case charge tunnels is a more accurate description) are accurately aligned and of the appropriate diameter so as to be easily registrable with the corresponding orifices in an orifice plate. This is accomplished by coating a metal which is relatively more difficult to deplate on a metal core wire which is relatively easier to deplate, the core wire being of a diameter corresponding to the desired diameter of the hole in the charge tunnel, positioning a plurality of the thus coated wires on a nonconductive support plate in parallel spaced relation, securing the coated wires to the support plate with nonconductive means such as epoxy resin, then deplating the core wires to leave the coating to form the charge tunnels or electrodes of the charge plate defining holes through which the droplets of printing liquid can pass to be charged. An alternative method in fabrication includes the step of holding the coated wires in properly spaced relation on a temporary frame structure and then forming at least part of the support plate about the coated wires rather than having the completely preformed support plate as mentioned above.

A further advantage to this easy method of fabrication is that a plurality of charge plates can be simultaneously fabricated by either technique. For example, where a preformed nonconductive support plate is utilized the plate can be prenotched to support a plurality of the coated wires in parallel aligned relation and then themselves aligned so that the notches are in registry but with the support plates in spaced parallel relation and supporting the coated wires. After the wires are secured to the plurality of support plates they are then severed from one another by cutting between each adjacent pair of support plates so that a plurality of charge plates are formed. The wires are then made flush with the surface of the support plate perpendicular to the axis of the wires prior to their being deplated so that they are in final form after deplating.

Conductive leads are secured to the surface of the support plate extending away from the charge tunnels and can, if desired, be fabricated at the same time the coated wires are secured to the support plate. In some fabrications it may be necessary to utilize conductive epoxy at the junction between the leads and the formed charge tunnels to complete the circuit.

DETAILED DESCRIPTION OF THE PREFERRED METHOD

The most important aspect of the present invention involves the use of core wires which are relatively more easy to deplate and which are coated with a metal which is relatively more difficult to deplate so that after fabrication of a charge plate the core wire can be deplated from within the coating so that the coating forms a cylindrical charge tunnel. The wire and the coating must be selected so that the coating will remain after the wire has been completely removed from the center of the coating by either a chemical or electro-chemical deplating process. It is therefore relatively unimportant exactly where the lessor or more difficult metals to deplate lie in the group of metals which can be deplated, so long as the center wire can be deplated while the coating will be left to form the charge tunnel.

For example, the metal which forms the core wire can be copper while the coating can, for example, be passive nickel, silver or gold. This is by no means a complete listing of usable metals since there are many others which can be deplated and would thus be useful in practicing the method of the present invention. It is thus to be understood that these terms are relative and in certain cases a particular metal can be either more or less difficult to deplate relative to the other metal selected for practicing the method of the present invention.

Figure 1:
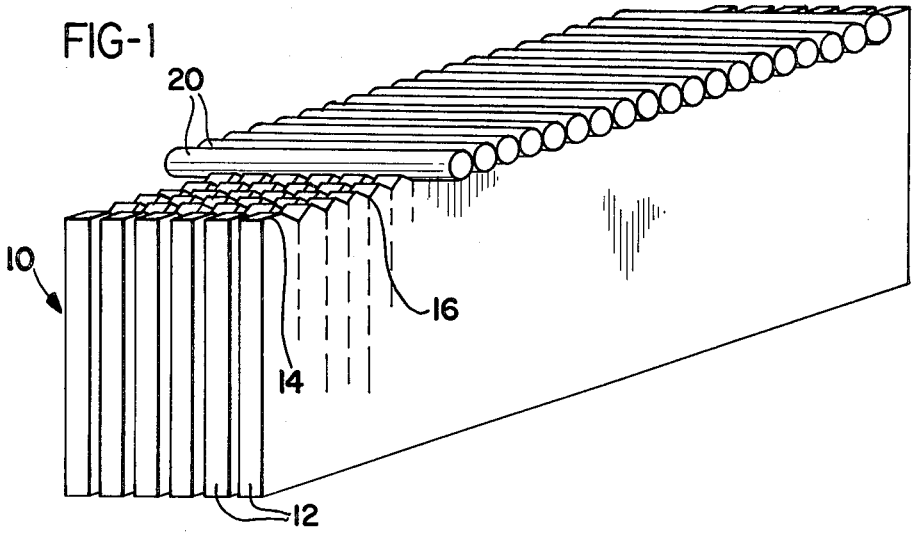
FIG. 1 is a pictorial illustration of a plurality of support plates with a plurality of coated wires positioned in notches formed therein to be formed into charge plate assemblies in accordance with the present invention.
Figure 2:
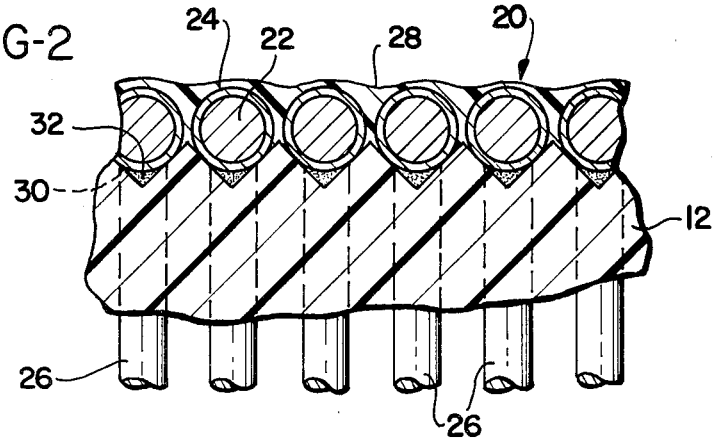
FIG. 2 is an enlarged cross sectional view through a portion of one of the charge plates illustrated in FIG. 1 with epoxy applied around the coated wires and leads extending away from each of the coated wires.

Referring now to the actual preferred method of fabricating charge plates in accordance with the present invention, a first basic construction is illustrated in FIGS. 1 and 2 with FIG. 1 illustrating a plurality of partially fabricated charge plates 10 formed from support plates 12, each of which has an upper edge portion 14 provided with a plurality of V-shaped notches 16. All of the notches of adjacent support plates 12 are aligned in registry as shown, to support the plurality of coated wires 20 which will eventually form charge tunnels. The support plates 12 are positioned in spaced parallel relation so that they may be easily separated by an appropriate cutting device at an interim stage of the fabrication as discussed below.

The support plates 12 can be fabricated from numerous materials so long as the material exhibits sufficient dimensional stability for the length of charge plate 10 being fabricated so that the ultimate fabrication will not become misaligned with corresponding orifices formed in the orifice plate (not shown) due to expansion or contraction of the material forming the charge plate 10. It is also, of course, important that the support plate 12 or at least the edge portion thereof which engages the coated wires 20, be formed of nonconductive material so as to act as an insulator between adjacent charge rings and associated circuitry. For example, support plates 10 can be fabricated from cast epoxies, ceramic-glass compounds or silicon.

There are numerous ways of forming the notches 16 in an edge portion 14 of the support plate, depending upon the material selected for the support plate. For example, if the material is silicon there is a known technique for etching highly accurate notches at equal distances along the surface of the material to form essentially V-shaped notches. With cast epoxy, a die or form which will impart appropriately spaced and formed grooves can be used to form the support plate while it is curing.

As mentioned above, the coated wires 20 which are positioned in the notches 16 are formed having a more easily deplated metal wire core 22 which has been coated with a layer 24 of relatively more difficult to deplate metal which will eventually form the charge tunnels. A plurality of these coated wires 20 are then positioned in each of the series of notches as shown in FIG. 1 so that they are supported at equal distances between their longitudinal axes and in substantially parallel relation. The core wire 22 is selected with its diameter equal to the intended final diameter of the charge ring which will ultimately be formed by the layer 24 when the core wire 22 is removed.

As shown in FIG. 2, a plurality of conductive leads 26, one each being associated with each coated wire 20, are plated or otherwise imbedded or secured to the support plate 12 extending away from each of the coated wires 20 and which will ultimately be connected to control circuitry (not shown) for selectively placing an electric charge on each of the charge tunnels in a well-known manner. Since the leads 26 are preferably secured to the surface of the support plate 12 prior to removal of the core wire 22 from the charge tunnels, they are formed of relatively more difficult to deplate metal so that they are not removed during the deplating process used to remove the central core wire 22 as described below.

In order to secure the coated wires 20 to the support plates 12 a layer of epoxy or an equivalent nonconductive cement is applied over and around the coated wires 20 and in engagement with the uncovered surfaces of the support plate 12 as best seen in FIG. 2. Since it is obviously necessary to have contact between the leads 26 and the layer 24 which will eventually form the charge tunnel, where the notches 16 are formed so that there is very little contact between the end portion 30 of the leads 26 and the outer surface of the layer 24, a layer of conductive epoxy resin 32 or equivalent must be used to fill the gap in order to provide a conductive path between the layer 24 and leads 26. After the coated wires 20 are secured in the support plate 12 they are cut off flush with the surface of the plate before the core wire 22 is deplated.

Referring to the actual deplating process, this can be accomplished in anyone of several well known ways. As an example, a chemical etchant which will deplate, for example, copper while not attacking nickel, can be applied to the fabricated charge plate so that the core wire 22 which would be made of copper would be etched out of a layer 24 of nickel forming the charge tunnels. Alternatively, an electro-chemical etching process could be used where individual leads are attached to each core wire 22 and then the fabricated charge plate is immersed in a chemical solution and a voltage applied to the individual leads so as to electro-deplate the central core wire 22 from the layer 24 to form the charge tunnel. The details of these processes are well known in the art and will therefore not be discussed further herein.

Figure 3:
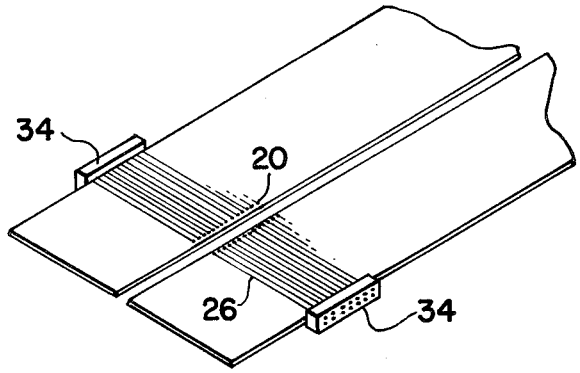
FIG. 3 is a pictorial view of a pair of charge plates fabricated in accordance with the present invention and positioned as they would be located beneath adjacent parallel rows of orifices in an orifice plate.

After the charge plate 10 has been fabricated it is installed in an ink jet printing device of the type mentioned in the above referred to patents. An example of proper positioning is illustrated in FIG. 3 where a pair of charge plates 10 made in accordance with the present invention are shown in the position in which they would be placed underneath two adjacent rows of orifices (not shown) which would each have an orifice lined up with a respective charge tunnel 24 with the leads 26 being connected to a junction block 34 into which can be coupled the control circuitry (not shown).

Figure 4:
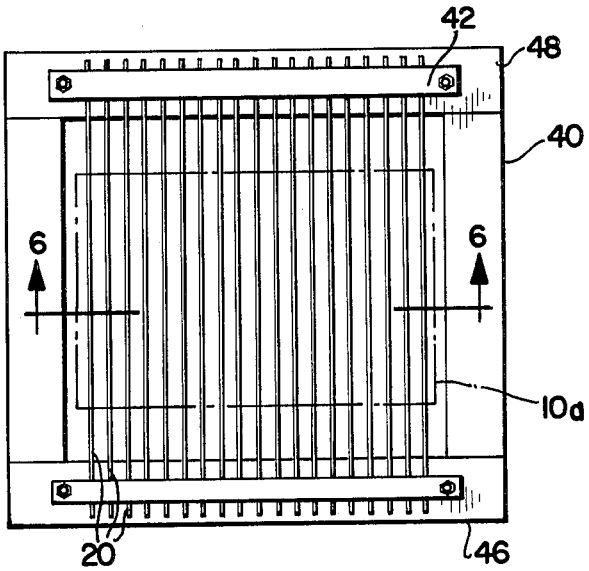
FIG. 4 is a plan view of a frame structure used as an alternative means for forming a charge plate wherein the wires are supported by the frame in proper parallel alignment with the support plate shown in phantom as it would be formed around the wires.
Figure 5:
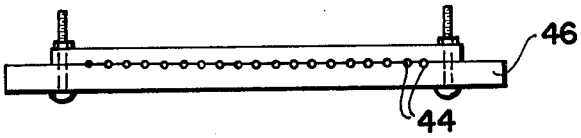
FIG. 5 is an end view looking axially of the wires and the frame structure as shown in FIG. 4 illustrating the notches formed in the frame structure to support the coated wires in properly aligned position during formation of the support plate.
Figure 6:
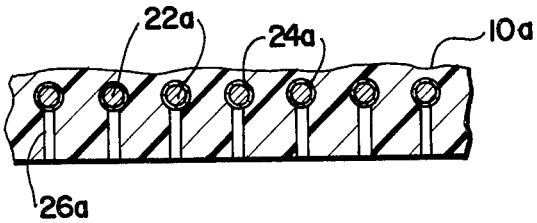
FIG. 6 is a cross sectional view along lines 6—6 of FIG. 4 illustrating a charge plate which has been fabricated about the coated wires.

An alternative method of forming charge tunnels in accordance with the present invention is described in connection with FIGS. 4–6. In this alternative method the plurality of coated wires 20 are secured to a frame structure 40 in parallel spaced relation and are held in position by a keeper member 42 which holds the wires 20 temporarily in position. Looking at FIG. 5, a plurality of V-notches 44 are formed along the surface of each end member 46 and 48 of the frame structure 40 and are aligned during fabrication of the frame 40 so that the wires placed in the respective V-grooves 44 will be in parallel equally spaced relation across the surface of the frame 40.

A support plate 10*a* is then formed about the wires 20. For example, an epoxy resin can be used and formed in a desired final shape for the support plate 10 by using a mold (not shown) of the desired final shape which can then be fitted about the wires and held in place while the epoxy resin cures. Once the mold is removed, the wires can then be removed from the frame structure 40 and will be secured in place in the support plate 10*a* as shown in cross section in FIG. 6. In this manner the support plate can be formed in any desired shape and can also be provided with imbedded leads similar to 26 as shown in FIG. 2 for providing an electric current to the charge rings 24 in the same manner as described above. In this case, however, the leads 26*a* can be imbedded directly in the epoxy material as it is formed.

Although the foregoing describes the preferred method of the present invention, other variations are possible. All such variations as would be obvious to one skilled in this art are intended to be included within the scope of the invention as defined by the following claims.

What is claimed is:

1. A method of forming a charge plate for an ink jet printing device, wherein the steps comprising:

coating a relatively more difficult to deplate metal on a relatively easier to deplate core wire;

positioning a plurality of said coated wires on a nonconductive support plate having notches formed in an edge portion thereof at predetermined equal intervals and at sufficient depth to locate said coated wires in parallel spaced relation along said edge portion;

securing said coated wires to said support plate with nonconductive means;

making said coated wires flush with opposite surfaces of said support plate longitudinal to longitudinal axes of said coated wires;

deplating said core wires to leave said coating to form charge rings in said charge plate defining holes through which droplets of printing liquid can pass to be charged.

2. A method as defined in claim 1 wherein said coating step includes using as a core wire a wire which has a diameter equal to the desired final diameter of the holes for individual charge rings formed in said charge plate such that filaments and droplets extending from orifices in said ink jet printing device will be charged by said charge rings when passed therethrough.

3. A method as defined in claim 1 including using copper as the easier to deplate metal core wire and for the more difficult to deplate metal using a metal from the group consisting of passive nickel, silver or gold.

4. A method as defined in claim 1 wherein a plurality of said support plates are placed in parallel spaced relation with said notches aligned, placing a plurality of lengths of said coated wire in said aligned notches and after said step of securing said coated wires to said support plate, cutting said wires at the spaces formed between said parallel support plates so as to form a plurality of charge plates.

5. A method as defined in claim 2 wherein said step of securing said coated wires to said support plate with nonconductive means includes placing an epoxy resin on and around said coated wires in contact with the surface of said support plate and allowing said epoxy resin to cure so that said coated wires are adhesively secured to said support plate.

6. A method as defined in claim 5 including securing to said support plate conductive leads extending from said coating forming the charge tunnels along the surface of said support plate to a remote location for securement to circuitry to control electric charge to said charge tunnels individually.

7. A method as defined in claim 6 wherein a conductive epoxy resin is used to secure the coated wires to said support plate in the area of engagement with said conductive leads to form an electrical connection between said coating forming said charge tunnels and said leads.

* * * * *